US009981297B2

(12) United States Patent
Fiorucci

(10) Patent No.: US 9,981,297 B2
(45) Date of Patent: May 29, 2018

(54) COIL FORMING LAYING HEAD SYSTEM AND METHOD OF USING

(71) Applicant: RUSSULA CORPORATION, Dublin, OH (US)

(72) Inventor: Keith Fiorucci, Sturbridge, MA (US)

(73) Assignee: RUSSULA CORPORATION, Dublin, OH (US)

( * ) Notice: Subject to any disclaimer, the term of this patent is extended or adjusted under 35 U.S.C. 154(b) by 99 days.

(21) Appl. No.: 14/996,905

(22) Filed: Jan. 15, 2016

(65) Prior Publication Data

US 2016/0207087 A1 Jul. 21, 2016

Related U.S. Application Data

(60) Provisional application No. 62/104,966, filed on Jan. 19, 2015.

(51) Int. Cl.

| | |
|---|---|
| ***B21C 47/14*** | (2006.01) |
| ***B65H 57/24*** | (2006.01) |
| ***B65H 57/12*** | (2006.01) |

(52) U.S. Cl.

CPC ..... *B21C 47/143* (2013.01); *B65H 57/12* (2013.01); *B65H 57/24* (2013.01)

(58) Field of Classification Search

CPC ..... B65H 57/12; B65H 57/24; B21C 47/143
See application file for complete search history.

(56) References Cited

U.S. PATENT DOCUMENTS

| | | | |
|---|---|---|---|
| 5,312,065 A | 5/1994 | Shore et al. | |
| 5,590,848 A | 1/1997 | Shore et al. | |
| 6,179,237 B1 | 1/2001 | David et al. | |
| 6,196,486 B1 | 3/2001 | David et al. | |
| 6,345,780 B1 | 2/2002 | Poloni et al. | |
| 6,422,010 B1 * | 7/2002 | Julien | F01D 25/005 60/527 |
| 6,543,712 B2 | 4/2003 | Grimmel et al. | |
| 6,565,031 B2 | 5/2003 | Haak | |
| 6,769,641 B2 | 8/2004 | Pariseau et al. | |
| 7,806,356 B2 | 10/2010 | Poloni et al. | |
| 7,918,119 B2 | 4/2011 | Shore | |
| 8,004,136 B2 | 8/2011 | De Luca et al. | |
| 8,191,813 B2 | 6/2012 | Haak | |
| 8,316,679 B2 | 11/2012 | Fiorucci et al. | |
| 8,376,287 B2 | 2/2013 | Zhang | |
| 2001/0020662 A1 | 9/2001 | Rebel et al. | |
| 2003/0113049 A1 | 6/2003 | Shore et al. | |

(Continued)

FOREIGN PATENT DOCUMENTS

| | | |
|---|---|---|
| JP | 2004344947 A | 12/2004 |
| WO | 2013/070470 A1 | 5/2013 |

OTHER PUBLICATIONS

International Search Report for Application No. PCT/US2016/013656, dated Apr. 21, 2016, 1 page.

(Continued)

*Primary Examiner* — William E Dondero

(74) *Attorney, Agent, or Firm* — Abel Law Group, LLP

(57) ABSTRACT

A coil-forming laying head system including a laying pathway structure defining an elongated hollow pathway adapted to transport elongated materials therein, the laying pathway structure having a flexibility of at least about 50 mm at 23° C.

20 Claims, 5 Drawing Sheets

(56) References Cited

U.S. PATENT DOCUMENTS

| | | | |
|---|---|---|---|
| 2011/0108652 | A1 | 5/2011 | Wojtkowski, Jr. et al. |
| 2013/0048773 | A1 | 2/2013 | Titus et al. |
| 2013/0075229 | A1 | 3/2013 | Fiorucci et al. |
| 2013/0075513 | A1 | 3/2013 | Fiorucci |
| 2013/0075514 | A1 | 3/2013 | Fiorucci |
| 2013/0075515 | A1 | 3/2013 | Fiorucci |
| 2013/0075516 | A1 | 3/2013 | Fiorucci |
| 2013/0081254 | A1 | 4/2013 | Fiorucci et al. |
| 2013/0112796 | A1 | 5/2013 | Vasi et al. |
| 2014/0070039 | A1 | 3/2014 | Shen et al. |

OTHER PUBLICATIONS

HHS Tube, fwmetals.com, Fort Wayne Metals Research Products Corp., 2009, pp. 28-29.

* cited by examiner

COIL FORMING LAYING HEAD SYSTEM AND METHOD OF USING

CROSS-REFERENCE TO RELATED APPLICATION(S)

This application claims priority under 35 U.S.C. § 119(e) to U.S. Patent Application No. 62/104,966, entitled "A COIL FORMING LAYING HEAD SYSTEM AND METHOD OF USING," by Keith Fiorucci, filed Jan. 19, 2015, which is assigned to the current assignee hereof and incorporated herein by reference in its entirety.

BACKGROUND

Field of the Disclosure

The following is directed to a coil-forming laying head system, and particularly, a coil-forming laying head system including a laying pathway structure.

Description of the Related Art

In a typical rod rolling mill, as depicted diagrammatically in FIG. 1, billets are reheated in a furnace 10. The heated billets are extracted from the furnace and rolled through a roughing mill 12, an intermediate mill 14, and a finishing mill 16 followed in some cases by a post finishing block (not shown). The finished products are then directed to a laying head 18 where they are formed into rings 20. The rings are deposited on a conveyor 22 for transport to a reforming station 24 where they are gathered into coils. While in transit on the conveyor, the rings can be subjected to controlled cooling designed to achieve selected metallurgical properties.

Over the last several decades, the delivery speeds of rod rolling mills have increased steadily. With the increased speed in delivery of the hot rolled product, the forces exerted on the laying pipe are also increased, causing internal pipe surfaces to undergo wear. Wear of the laying pipe can lead to a reduced ability to deliver a stable ring pattern to the conveyor 22, which can affect the cooling and ultimately the end properties of the product. Replacement of a laying pipe is a time consuming and costly issue for a mill. The combination of larger than desired laying head pipe internal diameter and reduced rolling speeds have been implemented in order to schedule preventive maintenance pipe replacement during scheduled maintenance "downtime". Conventional and current laying head pipes must be replaced after processing quantities of elongated material of approximately 2,000 tons or less, depending on diameter, speed and product composition.

Moreover, the fabrication of a conventional laying pipe is not simple. First a mandrel, which is used in the forming and contouring of the laying pipe must first be sourced. The formation of a mandrel having the precise contours necessary to form the laying pipe is a time consuming and costly venture. When forming the laying pipe on the mandrel, the laying pipe is first heated to a temperature above 900° C., which is a temperature that allows for manageable plastic deformation of the pipe by workers. The heated pipe is typically handled by workers and taken to the mandrel, where it is forcefully bent by hand around the mandrel using various hand tools to give it the appropriate three-dimensional shape. The process of handling and forming of the laying pipe is time-consuming and potentially hazardous for workers.

The industry continues to demand improvements in laying pipes to reduce mill downtime and reduce potentially hazardous conditions for workers.

SUMMARY

According to a first aspect, a coil-forming laying head system includes a laying pathway structure defining an elongated hollow pathway adapted to transport elongated materials therein, wherein the laying pathway structure comprises a flexibility of at least about 50 mm at 23° C.

In another aspect, a coil-forming laying head system includes a laying pathway structure comprising an elongated hollow pathway adapted to transport elongated materials therein, wherein the laying pathway structure comprises a metal alloy of nickel and titanium having an elemental ratio (Ni/Ti) of nickel and titanium within a range including at least about 0.05 and not greater than about 0.95.

For still another aspect, a coil-forming laying head system includes a laying pathway structure comprising an elongated hollow pathway adapted to transport elongated materials therein, wherein the laying pathway structure comprises a shape-memory metal.

In still another aspect, a coil-forming laying head system includes a laying pathway structure comprising an elongated hollow pathway adapted to transport elongated materials therein, wherein the laying pathway structure comprises a superelastic material.

For another aspect, a coil-forming laying head system includes a laying pathway structure comprising an elongated hollow pathway adapted to transport elongated materials therein, wherein the laying pathway structure comprises a plurality of fibers forming a wound structure.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
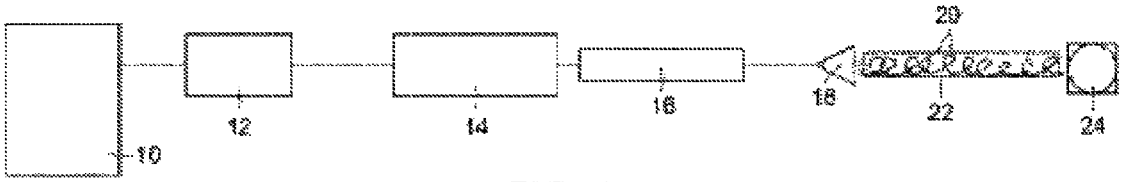
FIG. 1 Prior Art
FIG. 1 includes a diagram of a conventional rolling mill layout.

Referring generally to FIGS. 2-6 a coil-forming laying head system 30 and the laying pathway structure 60 can coil rolled elongated material M, such as for example hot, rolled steel, rod or rebar, into a helical formation of rings. The elongated material can have a linear velocity or speed S, which may be as high as or greater than approximately 29,520 feet/min (150 m/sec), can be received in the laying head system 30 intake end 32 and discharged in a series of continuous coil loops at the discharge end 34, whereupon the coils may be deposited on a conveyor 40.

The laying head system 30 can have a quill 50 can be configured to rotate about an axis 113. More particularly, the quill 50 can have a generally horn shape that is adapted to rotate about the axis 113. The laying head system may also include a laying pathway structure 60 and a pipe path support 70, which may be coupled to the quill 50. The laying pathway structure 60 and the pipe path support 70 may be configured to rotate about the axis 113 with the quill 50 during operation. The laying pathway structure 60 can be coupled to a pipe support 70 that is in turn coupled coaxially to the quill 50, so that all three components rotate synchronously about the quill 50 rotational axis 113. The quill 50 rotational speed can be selected based upon, among other factors, the elongated material M structural dimensions and material properties, advancement speed S, desired coil diameter and number of tons of elongated material that can be processed by the laying head pipe without undue risk of excessive wear.

The laying pathway structure 60 can define a hollow elongated cavity adapted to transport the elongated material M through its interior cavity. Aspects of the present invention allow the laying pathway structure 60 to include a laying head pipe. In fact, the laying pathway structure 60 may occasionally be referred to herein as a laying head pipe. The laying pathway structure 60 can have a generally helical axial profile of increasing radius, with a first end 62 that that is aligned with the rotational axis of quill 50 and configured to receive the elongated material M, which may be a metal product, which can be formed into a helical formation of rings. The first end 62 can be part of a proximal portion of the laying pathway structure 60. The laying pathway structure 60 can further include a second end 64 that can be part of a terminal portion of the laying pathway structure 60 displaced radially and axially from the proximal portion. The second end 64 can be spaced radially outwardly from and generally tangential to the quill 50 rotational axis 113 and thus discharges the elongated material M generally tangentially to the periphery of the rotating quill 50.

As illustrated, as elongated material M can be discharged from the second end 64, and may be directed into a guide 80 having guide rim segments 82 into which are formed a guide channel 84 having a helical pitch profile. As the elongated material M is advanced through the guide 80 it may be conformed into a helical formation of rings. The elongated material M can be configured into a helical formation of rings as the elongated material M traverses through the guide 80 and guide channel 84. The guide 80 can be coupled to the pipe support 70 and configured to rotate coaxially with the quill 50. The guide channel 84 rotational speed is substantially the same as the advancement speed S of the elongated material M advancement speed S, such that there may be essential no linear motion speed between the guide channel 84 and elongated material M, which may facilitate less wear of the surfaces of the guide channel 84 that contact the elongated material M.

A stationary end ring 90 can have an inner diameter that is coaxial with the quill 50 rotational axis 113 and circumscribes the second end 64 of the laying pathway structure 60 as well as the guide 80. The end ring 90 can counteract a centrifugal force imparted on the elongated material M as it is discharged from the laying head pipe 60 by radially restraining the elongated material M within the inner diameter surface of the end ring 90.

Figure 2:
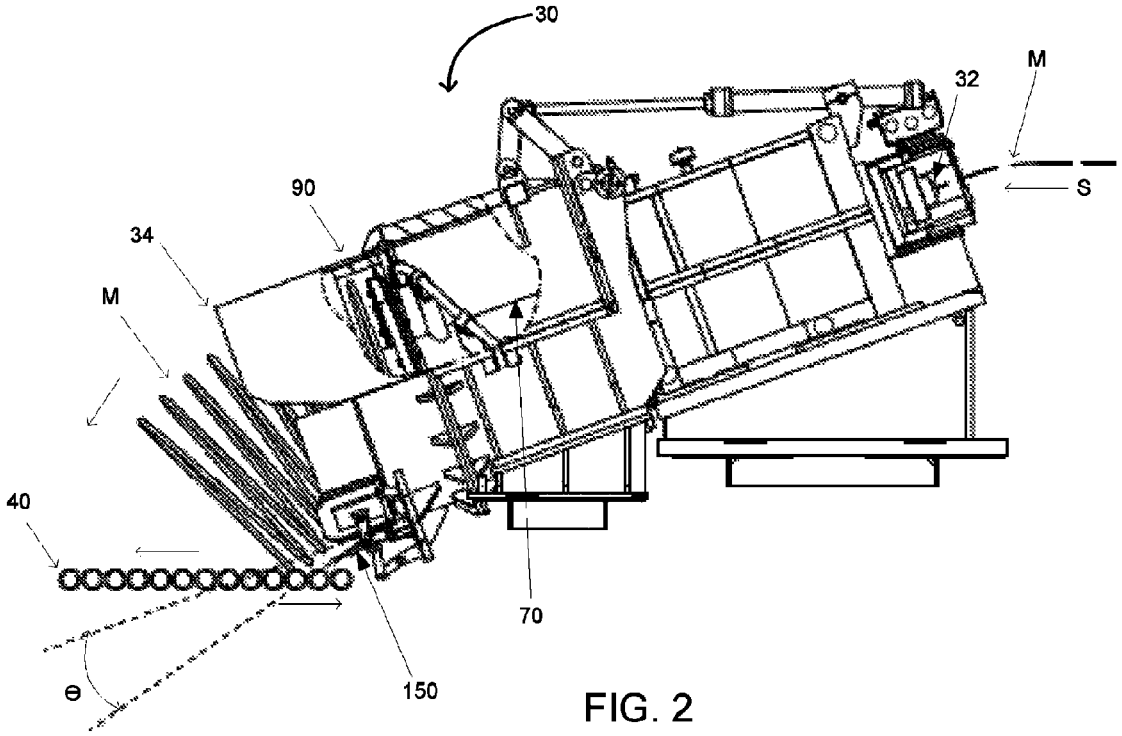
FIG. 2 includes a side view of a coil-forming laying head in accordance with an exemplary embodiment.
Figure 3:
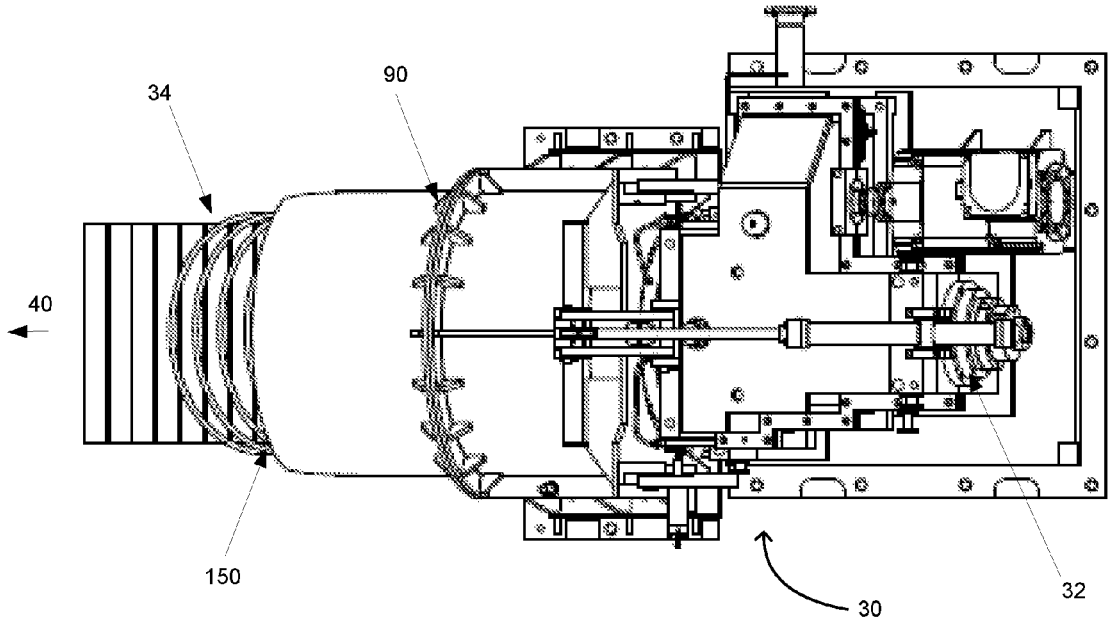
FIG. 3 includes a top plan view of the coil-forming laying head of FIG. 2 in accordance with an embodiment.
Figure 4:
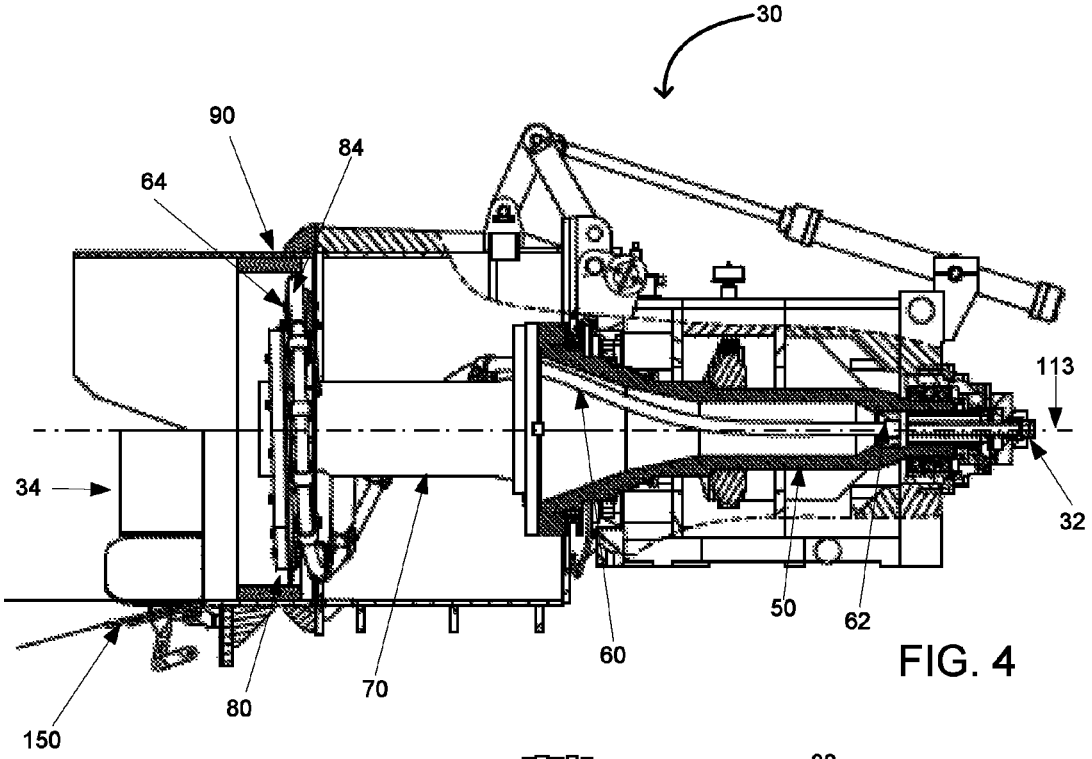
FIG. 4 includes a sectional view of the coil-forming laying head of FIG. 2 in accordance with an embodiment.
Figure 5:
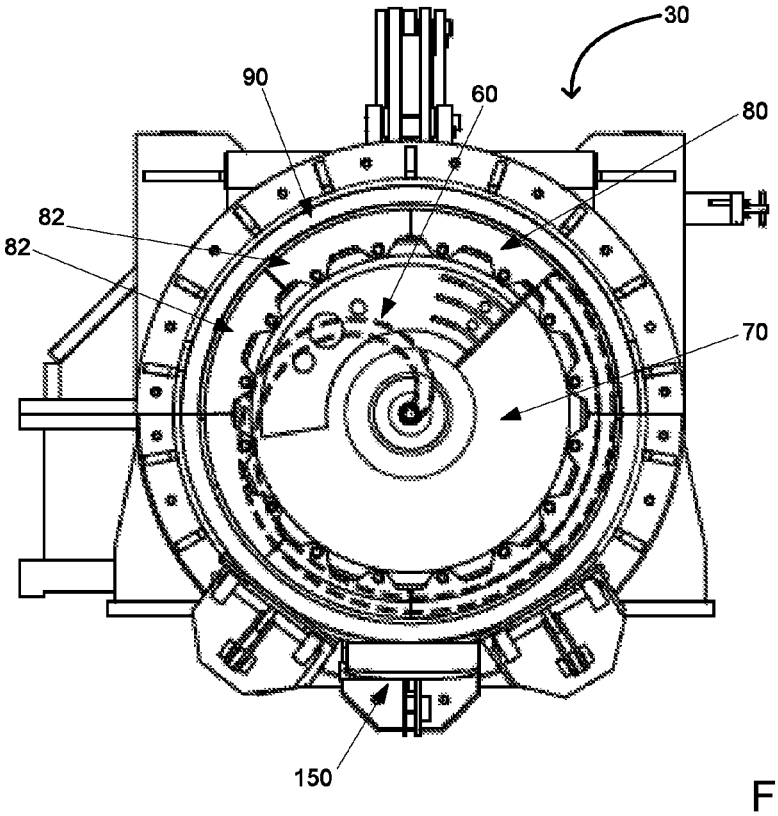
FIG. 5 includes a front view of the coil-forming laying head of FIG. 2 in accordance with an embodiment.

Referring to FIG. 2, the elongated material M can be discharged from the coil-forming system 30 by gravity in a helical formation of rings on conveyor 40, aided by the downwardly angled quill rotational axis at the system discharge end 34. A tripper mechanism 150 can be configured to pivot about an axis abutting the distal axial side of the end ring 90 guide surface. The pivotal axis can be tangential to the end ring 90 inner diameter guide surface about a pivotal angle θ. The coiling characteristics of the elongated material M and the placement of the helical formation of rings on the conveyor 40 can be controlled by varying the pivotal angle θ.

Figure 6:
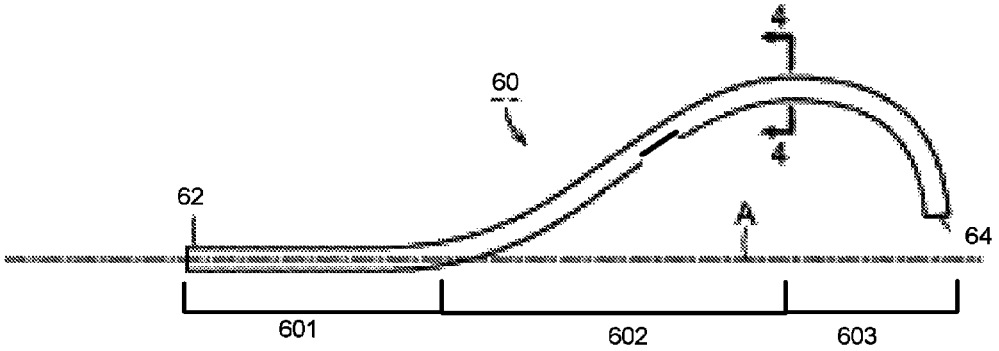
FIG. 6 includes a side view of a laying pathway structure according to an embodiment.

FIG. 6 includes a side view of a laying pathway structure according to an embodiment. With reference to FIGS. 2-5, the laying pathway structure 60 is configured for rotation about axis A, which may otherwise be the rotational axis 113 of the quill 50. The laying pathway structure 60 can have a first end 62 within the proximal portion 601, which is configured to extend along the axis A. The first end 62 can be aligned on axis A to receive a hot rolled product. The laying pathway structure 60 can further include a terminal portion 603 displaced radially and axially from the proximal portion 601 and including a second end 64, which is spaced radial away from the axis A. The laying pathway structure 60 can further include an intermediate portion 602 disposed between and extending between the proximal portion 601 and the terminal portion 603. The intermediate portion can define the portion of the laying pathway structure 60 that extends entirely along an arcuate path away from the axis A. The curved laying pathway structure 60 defines a guide path configured to form the product into a helical formation of rings. It will be appreciated that the laying pathway structures of the embodiments herein can be coupled to a mill line for forming metal products, and particularly a helical formation of rings, which may be useful to metal consumers.

Figure 7:
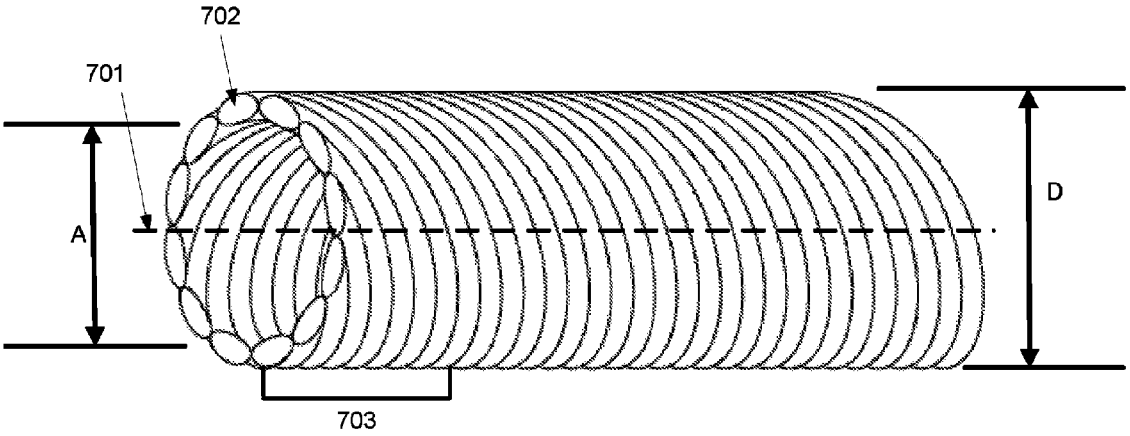
FIG. 7 includes a perspective view of a portion of the laying pathway structure according to an embodiment.
Figure 8:
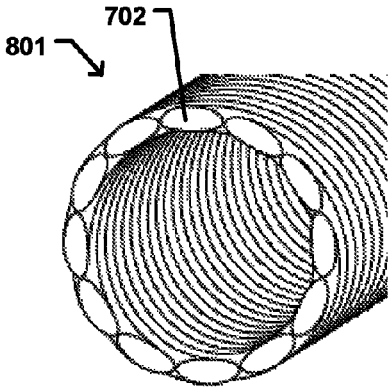
FIG. 8 includes a perspective and cross-sectional view of a portion of the laying pathway structure according to an embodiment.
Figure 9:
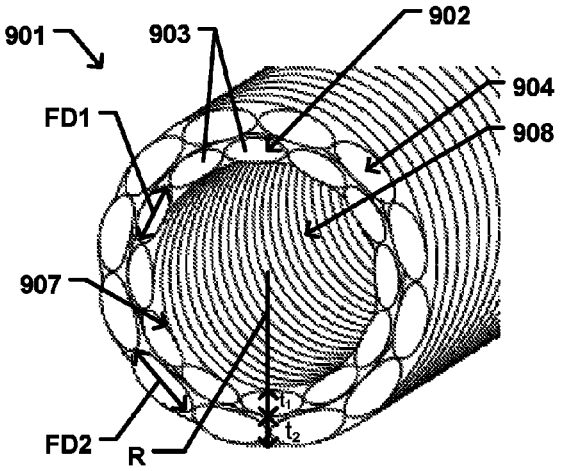
FIG. 9 includes a perspective and cross-sectional view of a portion of the laying pathway structure according to an embodiment.
Figure 10:
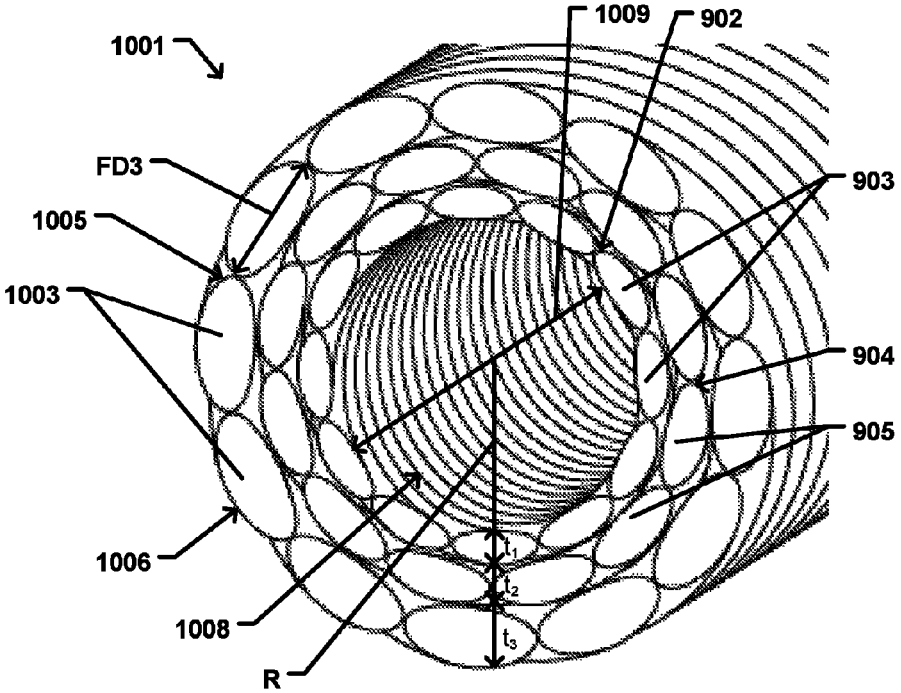
FIG. 10 includes a perspective and cross-sectional view of a portion of the laying pathway structure according to an embodiment.

FIGS. 7-10 include various images in various views of portions of laying pathway structures according to embodiments herein. FIG. 7 includes a perspective view of a portion of the laying pathway structure according to an embodiment. FIG. 8 includes a perspective and cross-sectional view of a portion of a laying pathway structure 801 according to an embodiment. FIG. 9 includes a perspective and cross-sectional view of a portion of the laying pathway structure according to an embodiment. FIG. 10 includes a perspective and cross-sectional view of a portion of the laying pathway structure according to an embodiment.

According to one embodiment, the laying pathway structure 60 can include at least one fiber 702 forming a wound structure defining a pitch 703, which can be defined as the linear distance along a longitudinal axis 701 of the laying pathway structure 60 needed to complete a single turn (i.e., 360°) of the fiber. It will be appreciated that the laying pathway structure 60 can include a plurality of fibers forming a wound structure. In certain instances, the pitch 703 can be at least equal to a diameter, such as an inner diameter A or an outer diameter D, of the laying pathway structure 60. More particularly, in at least one design, the pitch 703 can be greater than the diameter (A or D) of the laying pathway structure, such that the pitch is at least about twice the diameter, at least three times the diameter, at least five times the diameter, or even at least 10 times the diameter. Still, in another embodiment, the pitch can be not greater than 50 times the diameter. The relationship of the pitch to diameter can facilitate providing a laying pathway structure 60 having a suitable flexibility while still providing suitable mechanical integrity for metal forming applications.

It will be appreciated that the laying pathway structure 60 can include a plurality of fibers forming a wound structure. For example, in at least one embodiment, including for example the embodiment illustrated in FIG. 9, the laying pathway structure 901 can include an inner layer 902 including a plurality of fibers 903 forming a wound structure defining a first pitch and a second 904 layer overlying the inner layer 902 comprising a plurality of fibers 905 forming a wound structure defining a second pitch. According to one embodiment, the second layer 904 can be in direct contact with the inner layer 902, such that there are no intervening layers or materials. In particular, the second layer 904 can be bonded directly and fixedly attached to the inner layer 902. According to at least one alternative design, the second layer 904 can move relative to the inner layer 902, including but not limited to, circumferential displacement of the inner layer 902 relative to the second layer 904, as the laying pathway structure 901 is flexed.

In at least one embodiment, the first pitch (P1) can be different than the second pitch (P2). For example, the first pitch (P1) can be less than the second pitch (P2). Still, in other instances, the second pitch (P2) can be less than the first pitch (P1). In at least one other embodiment, the first pitch (P1) and the second pitch (P2) can be the same relative to each other.

In another embodiment, the first pitch (P1) can extend in a first direction and the second pitch (P2) can extend in a second direction. The first direction and the second direction can be the same relative to each other. Still, in another non-limiting embodiment, the first direction and the second direction can be different with respect to each other, and in particular, may extend in opposite directions relative to each other.

Each fiber 903, which may be part of a plurality of fibers, of the inner layer 902 can have a first fiber diameter (FD1) measured as the longest dimension of the fiber as viewed in a cross-sectional plane to the longitudinal axis 701 of the laying pathway structure 901. Moreover, each fiber 905, which may be part of a plurality of fibers, of the second layer 904 can have a second fiber diameter (FD2). In certain designs of the laying pathway structure, FD1 can be different compared to FD2. For example, in one embodiment, FD1 can be less than FD2. In another embodiment, FD1 can be greater than FD2. Still, according to one non-limiting embodiment, FD1 can be substantially the same as FD2, such that there is less than about a 2% difference between FD1 and FD2. Moreover, it will be appreciated that reference to FD1 and FD2 can represent average or mean values formed from a suitable sample size of diameters of the appropriate fibers.

According to one particular embodiment, the laying pathway structure 901 can have a particular fiber diameter factor (FD1/FD2) that may facilitate use of the laying pathway structure in the metal forming industry. For example, the fiber diameter factor (FD1/FD2) can be not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fiber diameter factor (FD1/FD2) can be at least about 0.05, such as at least about 0.1, at least about 0.2, at least about 0.3, at least about 0.4, at least about 0.5, at least about 0.6. It will be appreciated that the fiber diameter factor (FD1/FD2) can be within a range including any of the minimum and maximum values noted above.

In yet another embodiment, the laying pathway structure 901 can have a particular fiber diameter factor (FD2/FD1) that may facilitate use of the laying pathway structure in the metal forming industry. For example, the fiber diameter factor (FD2/FD1) can be not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fiber diameter factor (FD2/FD1) can be at least about 0.05, such as at least about 0.1, at least about 0.2, at least about 0.3, at least about 0.4, at least about 0.5, at least about 0.6. It will be appreciated that the fiber diameter factor (FD2/FD1) can be within a range including any of the minimum and maximum values noted above.

In particular instances, the first fiber diameter (FD1), which may be an average or mean value, can be at least about 0.5 mm, such as at least about 0.8 mm, at least about 1 mm, at least about 1.2 mm, at least about 1.5 mm, at least about 1.6 mm, at least about 1.8 mm, at least about 2 mm, at least about 2.2 mm, at least about 2.5 mm, at least about 2.8 mm, at least about 3 mm, at least about 3.2 mm, or even at least about 3.5 mm. Still, in one non-limiting embodiment, the first fiber diameter (FD1) can be not greater than about 10 mm, such as not greater than about 9 mm, not greater than about 8 mm, not greater than about 7 mm, not greater than about 6 mm, or even not greater than about 5 mm. It will be appreciated that the first fiber diameter (FD1) can be within a range including any of the minimum and maximum values noted above. Moreover, control of the first fiber diameter may provide a suitable combination of flexibility and resilience for use as in the laying pathway structure 901 in the metal forming industry.

In yet another aspect, the second fiber diameter (FD2), which may be an average or mean value, can be at least about 0.5 mm, such as at least about 0.8 mm, at least about 1 mm, at least about 1.2 mm, at least about 1.5 mm, at least about 1.6 mm, at least about 1.8 mm, at least about 2 mm, at least about 2.2 mm, at least about 2.5 mm, at least about 2.8 mm, at least about 3 mm, at least about 3.2 mm, or even at least about 3.5 mm. Still, in one non-limiting embodiment, the second fiber diameter (FD2) can be not greater than about 10 mm, such as not greater than about 9 mm, not greater than about 8 mm, not greater than about 7 mm, not greater than about 6 mm, or even not greater than about 5 mm. It will be appreciated that the second fiber diameter (FD2) can be within a range including any of the minimum and maximum values noted above. Moreover, control of the second fiber diameter may provide a suitable combination of flexibility and resilience for use as in the laying pathway structure 901 in the metal forming industry.

The first fiber 903, which may be part of a plurality of fibers of the inner layer 902, can have a first composition. The first composition can include a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material. In certain embodiments, the first composition can include a metal, such as a metal alloy. More particularly, the first composition may include a material selected from the group consisting of ferrous materials, ferrous compounds, non-ferrous materials, non-ferrous compounds, nickel, aluminum, titanium, platinum, vanadium, iron, steel, and a combination thereof. According to a particular embodiment, the first composition may consist essentially of a metal, and more particularly ferrous metal alloy, such as steel.

Still, in an alternative embodiment, the first composition can include at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

In certain instances, the second composition can be made of a material having a certain elastic modulus that facilitates formation and function of the laying pathway structure. For example, the second composition can have an elastic modulus of at least about 100 GPa, such as at least about 110 GPa, at least about 120 GPa, at least about 130 GPa, at least about 140 GPa, at least about 150 GPa, such as at least about 160 GPa, at least about 170 GPa, at least about 175 GPa, at least about 180 GPa. Still, in another non-limiting embodiment, the second composition can have an elastic modulus of not greater than about 400 GPa, not greater than about 350 GPa, not greater than about 300 GPa, not greater than about 290 GPa, not greater than about 280 GPa, not greater than about 270 GPa, not greater than about 260 GPa, not greater than about 250 GPa.

The second fiber 905, which may be part of a plurality of fibers of the second layer 904, can have a second composition. In certain instances, the first composition can be essentially the same as the second composition. The compositions may be essentially the same when the primary elemental materials or compounds are the same, excluding any impurity contents of materials. In another non-limiting embodiment, the first composition can be different than the second composition. The second composition can include a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material. In certain embodiments, the second composition can include a metal, such as a metal alloy. More particularly, the second composition may include a material selected from the group consisting of ferrous materials, ferrous compounds, non-ferrous materials, non-ferrous compounds, nickel, aluminum, titanium, platinum, vanadium, iron, steel, and a combination thereof. According to a particular embodiment, the second composition may consist essentially of a metal, and more particularly ferrous metal alloy, such as steel.

For at least one alternative embodiment, the second composition can include at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

In certain instances, the first composition can be made of a material having a certain elastic modulus that facilitates formation and function of the laying pathway structure. For example, the first composition can have an elastic modulus of at least about 100 GPa, such as at least about 110 GPa, at least about 120 GPa, at least about 130 GPa, at least about 140 GPa, at least about 150 GPa, such as at least about 160 GPa, at least about 170 GPa, at least about 175 GPa, at least about 180 GPa. Still, in another non-limiting embodiment, the first composition can have an elastic modulus of not greater than about 400 GPa, not greater than about 350 GPa, not greater than about 300 GPa, not greater than about 290 GPa, not greater than about 280 GPa, not greater than about 270 GPa, not greater than about 260 GPa, not greater than about 250 GPa.

For certain embodiments, one or more portions of the laying pathway structure 901 can include a wear-resistant coating (e.g., a boronized coating) or a wear-resistant material. In at least one embodiment, the inner layer 902 can have a wear resistance that is greater than a wear resistance of the second layer 904. More particularly, the inner surface 907 of the inner layer 902 defining the cavity 908 in the interior of the laying pathway structure 901 can include a wear resistant material or have a wear resistant coating.

In another embodiment, the inner layer 902 can have a first thickness ($t_1$) and the second layer 904 can have a second thickness ($t_2$), wherein the first thickness and the second thickness can be an average or mean value based on a suitable sampling of thickness values of the appropriate layer. Moreover, the first thickness and the second thickness can be the dimension of the layer measured along a radius R of the laying pathway structure 901 as viewed in cross-section to the longitudinal axis 701 of the laying pathway structure 901. According to one embodiment, $t_1$ is different compared to $t_2$. In yet another embodiment, $t_1$ is substantially the same as $t_2$, such that there is not greater than about a 2% difference between their values. For another embodiment, $t_1$ may be greater than $t_2$. Still, in another non-limiting embodiment, $t_1$ can be less than $t_2$.

The laying pathway structure 901 may have a particular ratio between the first thickness and the second thickness to facilitate use of the structure in metal forming applications. For example, the laying pathway structure 901 can have a first thickness ratio ($t_1/t_2$) not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the first thickness ratio ($t_1/t_2$) can be at least about 0.05, such as at least about 0.1, at least about 0.2, at least about 0.3, at least about 0.4, at least about 0.5, or even at least about 0.6. It will be appreciated that the first thickness ratio ($t_1/t_2$) can be within a range including any of the minimum and maximum values noted above.

In the alternative, the laying pathway structure 901 may have a particular ratio between the second thickness and the first thickness to facilitate use of the structure in metal forming applications. For example, the laying pathway structure 901 can have a second thickness ratio ($t_2/t_1$) not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the second thickness ratio ($t_2/t_1$) can be at least about 0.05, such as at least about 0.1, at least about 0.2, at least about 0.3, at least about 0.4, at least about 0.5, or even at least about 0.6. It will be appreciated that the second thickness ratio ($t_2/t_1$) can be within a range including any of the minimum and maximum values noted above.

In more particular instances, the first thickness ($t_1$) can be at least about 0.1 mm, such as at least about 0.2 mm, at least about 0.5 mm, at least about 0.5 mm, or even at least about 1 mm. In yet another instance, the first thickness ($t_1$) can be not greater than about 10 mm, such as not greater than about 8 mm, not greater than about 6 mm, not greater than about 4 mm. It will be appreciated that the first thickness ($t_1$) can be within a range including any of the minimum and maximum values noted above.

According to another embodiment, the second thickness ($t_2$) can be at least about 0.1 mm, such as at least about 0.2 mm, at least about 0.5 mm, at least about 0.5 mm, or even at least about 1 mm. In yet another instance, the second thickness ($t_2$) can be not greater than about 10 mm, such as not greater than about 8 mm, not greater than about 6 mm, not greater than about 4 mm. It will be appreciated that the second thickness ($t_2$) can be within a range including any of the minimum and maximum values noted above.

In least one embodiment, such as the embodiment illustrated in FIG. 10, the laying pathway structure 1001 can include an inner layer 902 including a plurality of fibers 903 forming a wound structure defining a first pitch, a second layer 904 overlying the inner layer 902 comprising a plurality of fibers 905 forming a wound structure defining a second pitch, and a third layer 1005 overlying the second layer 904 comprising a plurality of fibers 1003 forming a wound structure defining a third pitch. In certain instances, the third layer 1005 can be in direct contact with the second layer 904 and the second layer 904 can be in direct contact with the inner layer 902. According to one embodiment, the second layer 904 can be in direct contact with the inner layer 902, such that there are no intervening layers or materials between them and third layer 1005 can be in direct contact with the second layer 904 such that there are no intervening layers or materials between them. In particular, the second layer 904 can be bonded directly and fixedly attached to the third layer 1005. According to at least one alternative design, the third layer 1005 can move relative to the inner layer 902, including but not limited to, circumferential displacement of the inner layer 902 relative to the second layer 904 or third layer 1005 as the laying pathway structure 1001 is flexed.

In at least one embodiment, the first pitch (P1) can be different than the third pitch (P3). For example, the first pitch (P1) can be less than the third pitch (P3). Moreover, in at least one embodiment, the second pitch (P2) can be different than the third pitch (P3). For example, the second pitch (P2) can be less than the third pitch (P3). In at least one other embodiment, the first pitch (P1) and the second pitch (P2) can be the same relative to each other.

In another embodiment, the first pitch (P1) can extend in a first direction and the third pitch (P3) can extend in a third direction. The first direction and the third direction can be the same relative to each other. Still, in another non-limiting embodiment, the first direction and the third direction can be different with respect to each other, and in particular, may extend in opposite directions relative to each other.

Moreover, the second pitch (P2) can extend in a second direction and the third pitch (P3) can extend in a third direction. The second direction and the third direction can be the same relative to each other. Still, in another non-limiting embodiment, the second direction and the third direction can be different with respect to each other, and in particular, may extend in opposite directions relative to each other.

Each fiber 1003, which may be part of a plurality of fibers, of the third layer 1005 can have a third fiber diameter (FD3) measured as the longest dimension of the fiber as viewed in a cross-sectional plane to the longitudinal axis 701 of the laying pathway structure 1001. Moreover, as noted in FIG. 9 the first fibers 903 of the inner layer 902 can have a first fiber diameter FD1 and the second fibers 905 of the second layer 904 can have a second fiber diameter (FD2). In certain designs of the laying pathway structure, FD1 can be different compared to FD3. For example, in one embodiment, FD1 can be less than FD3. In another embodiment, FD1 can be greater than FD3. Still, according to one non-limiting embodiment, FD1 can be substantially the same as FD3, such that there is less than about a 2% difference between FD1 and FD3. Moreover, it will be appreciated that reference to FD1 and FD3 can represent average or mean values formed from a suitable sample size of diameters of the appropriate fibers.

For certain other embodiments, FD2 can be different compared to FD3. For example, in one embodiment, FD2 can be less than FD3. In another embodiment, FD2 can be greater than FD3. Still, according to one non-limiting embodiment, FD2 can be substantially the same as FD3, such that there is less than about a 2% difference between FD2 and FD3. Moreover, it will be appreciated that reference to FD2 and FD3 can represent average or mean values formed from a suitable sample size of diameters of the appropriate fibers.

According to one particular embodiment, the laying pathway structure 1001 can have a particular fiber diameter factor (FD1/FD3) that may facilitate use of the laying pathway structure in the metal forming industry. For example, the fiber diameter factor (FD1/FD3) can be not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fiber diameter factor (FD1/FD3) can be at least about 0.05, such as at least about 0.1, at least about 0.2, at least about 0.3, at least about 0.4, at least about 0.5, at least about 0.6. It will be appreciated that the fiber diameter factor (FD1/FD3) can be within a range including any of the minimum and maximum values noted above.

In yet another embodiment, the laying pathway structure 1001 can have a particular fiber diameter factor (FD3/FD1) that may facilitate use of the laying pathway structure in the metal forming industry. For example, the fiber diameter factor (FD3/FD1) can be not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fiber diameter factor (FD3/FD1) can be at least about 0.05, such as at least about 0.1, at least about 0.2, at least about 0.3, at least about 0.4, at least about 0.5, at least about 0.6. It will be appreciated that the fiber diameter factor (FD3/FD1) can be within a range including any of the minimum and maximum values noted above.

According to one particular embodiment, the laying pathway structure 1001 can have a particular fiber diameter factor (FD2/FD3) that may facilitate use of the laying pathway structure in the metal forming industry. For example, the fiber diameter factor (FD2/FD3) can be not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fiber diameter factor (FD2/FD3) can be at least about 0.05, such as at least about 0.1, at least about 0.2, at least about 0.3, at least about 0.4, at least about 0.5, at least about 0.6. It will be appreciated that the fiber diameter factor (FD2/FD3) can be within a range including any of the minimum and maximum values noted above.

In yet another embodiment, the laying pathway structure 1001 can have a particular fiber diameter factor (FD3/FD2) that may facilitate use of the laying pathway structure in the metal forming industry. For example, the fiber diameter factor (FD3/FD2) can be not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fiber diameter factor (FD3/FD2) can be at least about 0.05, such as at least about 0.1, at least about 0.2, at least about 0.3, at least about 0.4, at least about 0.5, at least about 0.6. It will be appreciated that the fiber diameter factor (FD3/FD2) can be within a range including any of the minimum and maximum values noted above.

The third fiber diameter (FD3), which may be an average or mean value, can be at least about 0.5 mm, such as at least about 0.8 mm, at least about 1 mm, at least about 1.2 mm, at least about 1.5 mm, at least about 1.6 mm, at least about 1.8 mm, at least about 2 mm, at least about 2.2 mm, at least about 2.5 mm, at least about 2.8 mm, at least about 3 mm, at least about 3.2 mm, or even at least about 3.5 mm. Still, in one non-limiting embodiment, the third fiber diameter (FD3) can be not greater than about 10 mm, such as not greater than about 9 mm, not greater than about 8 mm, not greater than about 7 mm, not greater than about 6 mm, or even not greater than about 5 mm. It will be appreciated that the third fiber diameter (FD3) can be within a range including any of the minimum and maximum values noted above. Moreover, control of the third fiber diameter may provide a suitable combination of flexibility and resilience for use as in the laying pathway structure 901 in the metal forming industry.

The third fiber 1003, which may be part of a plurality of fibers of the third layer 1005, can have a third composition. The third composition can include a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material. In certain embodiments, the third composition can include a metal, such as a metal alloy. More particularly, the third composition may include a material selected from the group consisting of ferrous materials, ferrous compounds, non-ferrous materials, non-ferrous compounds, nickel, aluminum, titanium, platinum, vanadium, iron, steel, and a combination thereof. According to a particular embodiment, the third composition may consist essentially of a metal, and more particularly, a ferrous metal alloy, such as steel.

Still, in an alternative embodiment, the third composition can include at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

In certain instances, the third composition can be made of a material having a certain elastic modulus that facilitates formation and function of the laying pathway structure. For example, the third composition can have an elastic modulus of at least about 100 GPa, such as at least about 110 GPa, at least about 120 GPa, at least about 130 GPa, at least about 140 GPa, at least about 150 GPa, such as at least about 160 GPa, at least about 170 GPa, at least about 175 GPa, at least about 180 GPa. Still, in another non-limiting embodiment, the third composition can have an elastic modulus of not greater than about 400 GPa, not greater than about 350 GPa, not greater than about 300 GPa, not greater than about 290 GPa, not greater than about 280 GPa, not greater than about 270 GPa, not greater than about 260 GPa, not greater than about 250 GPa.

As noted in the foregoing, the first fibers 903 of the inner layer 902 can have a first composition and the second fibers 905 of the second layer 904 can have a second composition. In certain instances, the first composition can be essentially the same as the third composition. The compositions may be essentially the same when the primary elemental materials or compounds are the same, excluding any impurity contents of materials. In another non-limiting embodiment, the first composition can be different than the third composition. According to another embodiment, the second composition can be essentially the same as the third composition. Still, for other designs, the second composition can be different than the third composition.

For certain embodiments, one or more portions of the laying pathway structure 1001 can include a wear-resistant coating (e.g., a boronized coating) or a wear-resistant material. As described in the embodiment illustrated in FIG. 9, the inner layer 902 can have a wear resistance that is greater than a wear resistance of the second layer 904. More particularly, the inner surface 907 of the inner layer 902 defining the cavity 908 in the interior of the laying pathway structure 901 can include a wear resistant material or have a wear resistant coating. The same may be true for the embodiment of FIG. 10. In particular instances, one or more portions of the third layer 1005 may include a wear resistant material or include a wear resistant coating. For example, in at least one design, the outer surface 1006 of the third layer 1005 may include a wear resistant material or include a wear resistant coating.

As noted herein, the inner layer 902 can have a first thickness ($t_1$) and the second layer 904 can have a second thickness ($t_2$), wherein the first thickness and the second thickness can be an average or mean value based on a suitable sampling of thickness values of the appropriate layer. Moreover, the third layer 1005 can have a third thickness ($t_3$) defined as the dimension of the third layer 1005 measured along a radius R of the laying pathway structure 1001 as viewed in cross-section to the longitudinal axis 701 of the laying pathway structure 1001. According to one embodiment, $t_1$ is different compared to $t_3$. In yet another embodiment, $t_1$ is substantially the same as $t_3$, such that there is not greater than about a 2% difference between their values. For another embodiment, $t_1$ may be greater than $t_3$. Still, in another non-limiting embodiment, $t_1$ can be less than $t_3$.

The laying pathway structure 1001 may have a particular ratio between the first thickness and the third thickness to facilitate use of the structure in metal forming applications. For example, the laying pathway structure 1001 can have a third thickness ratio ($t_1/t_3$) not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the third thickness ratio ($t_1/t_3$) can be at least about 0.05, such as at least about 0.1, at least about 0.2, at least about 0.3, at least about 0.4, at least about 0.5, or even at least about 0.6. It will be appreciated that the third thickness ratio ($t_1/t_3$) can be within a range including any of the minimum and maximum values noted above.

In the alternative embodiment, the laying pathway structure 1001 may have a particular ratio between the third thickness and the first thickness to facilitate use of the structure in metal forming applications. For example, the laying pathway structure 1001 can have a fourth thickness ratio ($t_3/t_1$) not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fourth thickness ratio ($t_3/t_1$) can be at least about 0.05, such as at least about 0.1, at least about 0.2, at least about 0.3, at least about 0.4, at least about 0.5, or even at least about 0.6. It will be appreciated that the fourth thickness ratio ($t_3/t_1$) can be within a range including any of the minimum and maximum values noted above.

According to one embodiment, $t_2$ is different compared to $t_3$. In yet another embodiment, $t_2$ is substantially the same as $t_3$, such that there is not greater than about a 2% difference between their values. For another embodiment, $t_2$ may be greater than $t_3$. Still, in another non-limiting embodiment, $t_2$ can be less than $t_3$.

The laying pathway structure 1001 may have a particular ratio between the second thickness and the third thickness to facilitate use of the structure in metal forming applications. For example, the laying pathway structure 1001 can have a fifth thickness ratio ($t_2/t_3$) not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the fifth thickness ratio ($t_2/t_3$) can be at least about 0.05, such as at least about 0.1, at least about 0.2, at least about 0.3, at least about 0.4, at least about 0.5, or even at least about 0.6. It will be appreciated that the fifth thickness ratio ($t_2/t_3$) can be within a range including any of the minimum and maximum values noted above.

In the alternative embodiment, the laying pathway structure 1001 may have a particular ratio between the third thickness and the second thickness to facilitate use of the structure in metal forming applications. For example, the laying pathway structure 1001 can have a sixth thickness ratio ($t_3/t_2$) not greater than about 0.98, such as not greater than about 0.96, not greater than about 0.94, not greater than about 0.92, not greater than about 0.9, not greater than about 0.88, not greater than about 0.86, not greater than about 0.84, not greater than about 0.82, or even not greater than about 0.8. Still, in a non-limiting embodiment, the sixth thickness ratio ($t_3/t_2$) can be at least about 0.05, such as at least about 0.1, at least about 0.2, at least about 0.3, at least about 0.4, at least about 0.5, or even at least about 0.6. It will be appreciated that the sixth thickness ratio ($t_3/t_2$) can be within a range including any of the minimum and maximum values noted above.

In more particular instances, the third thickness ($t_3$) can be at least about 0.1 mm, such as at least about 0.2 mm, at least about 0.5 mm, at least about 0.5 mm, or even at least about 1 mm. In yet another instance, the third thickness ($t_3$) can be not greater than about 10 mm, such as not greater than about 8 mm, not greater than about 6 mm, not greater than about 4 mm. It will be appreciated that the third thickness ($t_3$) can be within a range including any of the minimum and maximum values noted above.

The laying pathway structures of the embodiments herein can have a particular wall thickness that may facilitate their use in the metal forming industry, and particularly as laying pipe in a coil forming laying head system. The wall thickness is generally understood to be the thickness of the wall of the laying pathway structure in the radial direction as viewed in cross-section, and more particularly, may be half of the difference between the outer diameter (D) and the inner diameter (A) (i.e., wall thickness=[0.5×(D−A)]. For one embodiment, the wall thickness of the laying pathway structure can be at least about 1 mm, such as at least about 2 mm, at least about 3 mm, at least about 4 mm, at least about 5 mm. In yet another non-limiting embodiment, the laying pathway structure can have a wall thickness of not greater than about 20 mm, such as not greater than about 18 mm, not greater than about 16 mm, not greater than about 14 mm. It will be appreciated that the wall thickness can be within a range including any of the minimum and maximum values noted above.

The laying pathway structure 1001 can have an inner width 1009, which may define the longest dimension of the cavity 1008 as viewed in cross-section to the longitudinal axis 701 of the laying pathway structure 1001. The width may be a diameter for a cavity having a circular cross-sectional shape, as illustrated in FIG. 10. According to an embodiment, the inner width 1009 can be at least about 1 mm, such as at least about 2 mm, at least about 3 mm, at least about 4 mm, at least about 5 mm, or even at least about 6 mm. It will be appreciated that the cavity can have a variety of cross-sectional shapes, including but not limited to, circular polygonal, elliptical, complex polygonal, irregular polygonal, irregular, random, and a combination thereof. In a non-limiting embodiment, the laying pathway structure 1001 can have an inner width 1009 of not greater than about 100 mm, not greater than about 80 mm, not greater than about 70 mm, not greater than about 60 mm, not greater than about 50 mm. It will be appreciated that the inner width 1009 can be within a range including any of the minimum and maximum values noted above.

The laying pathway structures of the embodiments herein have a particular flexibility at room temperature, which can facilitate simpler formation and maintenance than conventional laying pipe products. For example, the laying pathway structure of the embodiments herein can have a flexibility of at least about 55 mm at 23° C. based on the cantilever test. The cantilever test is based upon a straight 1.5 inch diameter schedule 160 tube having an outer diameter of 48.3 mm, and a wall thickness of 7.14 mm, which is attached to a fully rigid structure at a proximal end, and a weight of 1000 kgs is attached to the opposite terminal end of the tube. The tube has a length of 500 mm. The tube is attached to the fully rigid structure such that the proximal end is flush against the wall and the tube is parallel to the ground and perpendicular to the fully rigid structure. The pipe is then allowed to flex for a time of 60 seconds at room temperature (i.e., 23° C.). The change in the vertical distance of the terminal end of the pipe from the original height is recorded as the flexibility. The test may be repeated a number of times to achieve a statistically relevant sample size and calculate an average or mean flexibility value. The flexibility of the laying pathway structures of the embodiments herein can be at least about 60 mm (i.e., the terminal end dropped at least about 60 mm from an original starting height), such as at least about 65 mm, at least about 70 mm, at least about 75 mm, at least about 80 mm, at least about 90 mm, at least about 100 mm, or even at least about 110 mm. Still, in a non-limiting embodiment, the flexibility of the laying pathway structure can be not greater than about 490 mm, not greater than about 470 mm, not greater than about 450 mm, or even not greater than about 400 mm. It will be appreciated that the flexibility of the laying pathway structure can be within a range including any of the minimum and maximum values note above, including but not limited to, at least about 60 mm and not greater than about 490 mm, at least about 70 mm and not greater than about 470 mm, or at least about 80 mm and not greater than about 450 mm.

The laying pathway structures of the embodiments herein may include particular materials, which may facilitate improved operations and maintenance of the coil forming laying head system and mill. For example, at least a portion of a laying pathway structure of any of the embodiments herein can include a metal alloy of nickel and titanium having an elemental ratio (Ni/Ti) of nickel and titanium within a range including at least about 0.05 and not greater than about 0.95. According to one embodiment, the elemental ratio (Ni/Ti) of nickel and titanium can be at least about 0.08, such as at least about 0.1, at least about 0.15, at least about 0.2, at least about 0.25, at least about 0.3, at least about 0.35, at least about 0.4, at least about 0.45, or even at least about 0.48. Still, in another embodiment, the elemental ratio (Ni/Ti) of nickel and titanium can be not greater than about 0.9, such as not greater than about 0.85, not greater than about 0.8, not greater than about 0.75, not greater than about 0.7, not greater than about 0.65, not greater than about 0.6, not greater than about 0.55, or even not greater than about 0.53. It will be appreciated that the elemental ratio (Ni/Ti) of nickel and titanium can be within a range including any of the minimum and maximum values noted above. For at least one particular embodiment, at least a portion of the laying pathway structure comprises Nitinol™. Moreover, it will be appreciated that at least a fiber of any one of the laying pathway structures of the embodiments herein may include the foregoing material having a combination of nickel and titanium. In other instances, the entire structure of the laying pathway structure can be made of the metal alloy of nickel and titanium as disclosed herein.

According to another embodiment, at least a portion (e.g., a portion of a fiber or an entire fiber of one or more layers) of the laying pathway structure can include a shape-memory metal. More particularly, at least a majority by weight of the laying pathway structure can include a shape-memory metal. In at least one embodiment, the entire laying pathway structure can consist essentially of a shape-memory metal. It will be appreciated that at least a fiber of any one of the laying pathway structures of the embodiments herein may include the foregoing material. In other instances, the entire structure of the laying pathway structure can be made of the metal alloy of nickel and titanium as disclosed herein.

According to another embodiment, at least a portion (e.g., a portion of a fiber or an entire fiber of one or more layers) of the laying pathway structure can include a superelastic material. More particularly, at least a majority by weight of the laying pathway structure can include a superelastic material. In at least one embodiment, the entire laying pathway structure can consist essentially of a superelastic material. A superelastic material has a plastic strain threshold of at least about 5% strain without plastic deformation. That is, the superelastic material can undergo at least 5% elongation without suffering permanent deformation. In other instances, the superelastic material can undergo at least about 6% strain, such as at least about 7% strain, at least about 8% strain, at least about 9% strain, or even at least about 10% strain without permanent deformation. In one non-limiting embodiment, the superelastic material can undergo between 6% and 20% strain, such as between 7% and 18%, between 7% and 15%, between 7% and 13% strain without permanent deformation.

EMBODIMENTS

Embodiment 1

A coil-forming laying head system comprising:
a laying pathway structure defining an elongated hollow pathway adapted to transport elongated materials therein, wherein the laying pathway structure comprises a flexibility of at least about 50 mm at 23° C.

Embodiment 2

A coil-forming laying head system comprising:
a laying pathway structure comprising an elongated hollow pathway adapted to transport elongated materials therein, wherein the laying pathway structure comprises a metal alloy of nickel and titanium having an elemental ratio (Ni/Ti) of nickel and titanium within a range including at least about 0.05 and not greater than about 0.95.

Embodiment 3

A coil-forming laying head system comprising:
a laying pathway structure comprising an elongated hollow pathway adapted to transport elongated materials therein, wherein the laying pathway structure comprises a shape-memory metal.

Embodiment 4

A coil-forming laying head system comprising:
a laying pathway structure comprising an elongated hollow pathway adapted to transport elongated materials therein, wherein the laying pathway structure comprises a superelastic material.

Embodiment 5

A coil-forming laying head system comprising:
a laying pathway structure comprising an elongated hollow pathway adapted to transport elongated materials therein, wherein the laying pathway structure comprises a plurality of fibers forming a wound structure.

Embodiment 6

The coil-forming laying head system of any one of embodiments 1, 2, 3, 4, and 5, wherein the laying pathway structure comprises a plurality of fibers forming a wound structure defining a pitch (P), wherein the pitch (P) is at least equal to a diameter of the laying pathway structure.

Embodiment 7

The coil-forming laying head system of any one of embodiments 1, 2, 3, 4, and 5, wherein the laying pathway structure comprises a plurality of fibers forming a wound structure defining a pitch (P), wherein the pitch (P) is greater than a diameter of the laying pathway structure.

Embodiment 8

The coil-forming laying head system of embodiment 6, wherein the laying pathway structure comprises:

an inner layer comprising a plurality of fibers forming a wound structure defining a first pitch (P1); and a second layer overlying the inner layer comprising a plurality of fibers forming a wound structure defining a second pitch (P2).

Embodiment 9

The coil-forming laying head system of embodiment 8, wherein the second layer is in direct contact with the inner layer.

Embodiment 10

The coil-forming laying head system of embodiment 8, wherein the first pitch (P1) is different than the second pitch (P2).

Embodiment 11

The coil-forming laying head system of embodiment 8, wherein the first pitch (P1) is less than the second pitch (P2).

Embodiment 12

The coil-forming laying head system of embodiment 8, wherein the first pitch (P1) extends in a first direction and the second pitch (P2) extends in a second direction.

Embodiment 13

The coil-forming laying head system of embodiment 8, wherein the first direction is the same as the second direction.

Embodiment 14

The coil-forming laying head system of embodiment 8, wherein the first direction is different than the second direction.

Embodiment 15

The coil-forming laying head system of embodiment 8, wherein each of the fibers of the plurality of fibers of the inner layer comprises a first fiber diameter (FD1), and each of the fibers of the plurality of fibers of the second layer comprises a second fiber diameter (FD2).

Embodiment 16

The coil-forming laying head system of embodiment 15, wherein FD1 is different compared to FD2.

Embodiment 17

The coil-forming laying head system of embodiment 15, wherein FD1 is less than FD2.

Embodiment 18

The coil-forming laying head system of embodiment 15, wherein FD1 is greater than FD2.

Embodiment 19

The coil-forming laying head system of embodiment 15, wherein FD1 is substantially the same as FD2.

Embodiment 20

The coil-forming laying head system of embodiment 15, further comprising a fiber diameter factor (FD1/FD2) of not greater than about 0.98, not greater than about 0.96, not greater than about 0.94, not greater than about 0.92, not greater than about 0.9, not greater than about 0.88, not greater than about 0.86, not greater than about 0.84, not greater than about 0.82, not greater than about 0.80, and at least about 0.05, at least about 0.1, at least about 0.2, at least about 0.3, at least about 0.4, at least about 0.5, at least about 0.6.

Embodiment 21

The coil-forming laying head system of embodiment 15, wherein the first fiber diameter (FD1) is at least about 0.5 mm and not greater than about 10 mm.

Embodiment 22

The coil-forming laying head system of embodiment 15, wherein the second fiber diameter (FD2) is at least about 0.5 mm and not greater than about 10 mm.

Embodiment 23

The coil-forming laying head system of embodiment 8, wherein each of the fibers of the plurality of fibers of the inner layer comprises a first composition and each of the fibers of the plurality of fibers of the second layer comprises a second composition.

Embodiment 24

The coil-forming laying head system of embodiment 23, wherein the first composition is essentially the same as the second composition.

Embodiment 25

The coil-forming laying head system of embodiment 23, wherein the first composition is different than the second composition.

Embodiment 26

The coil-forming laying head system of embodiment 23, wherein the first composition comprises a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 27

The coil-forming laying head system of embodiment 23, wherein the first composition comprises a metal, wherein the first composition comprises a metal alloy, wherein the first composition comprises a material selected from the group consisting of ferrous materials, ferrous compounds, non-ferrous materials, non-ferrous compounds, nickel, aluminum, titanium, platinum, vanadium, iron, steel, and a combination thereof.

Embodiment 28

The coil-forming laying head system of embodiment 23, wherein the first composition comprises a composite including a combination of at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 29

The coil-forming laying head system of embodiment 23, wherein the second composition comprises a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 30

The coil-forming laying head system of embodiment 23, wherein the second composition comprises a metal, wherein the second composition comprises a metal alloy, wherein the second composition comprises a material selected from the group consisting of ferrous materials, ferrous compounds, non-ferrous materials, non-ferrous compounds, nickel, aluminum, titanium, platinum, vanadium, iron, steel, and a combination thereof.

Embodiment 31

The coil-forming laying head system of embodiment 23, wherein the second composition comprises a composite including a combination of at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 32

The coil-forming laying head system of embodiment 23, wherein the inner layer comprises a wear resistance that is greater than a wear resistance of the second layer.

Embodiment 33

The coil-forming laying head system of embodiment 23, wherein the inner layer comprises a first thickness (t1) and the second layer comprises a second thickness (t2).

Embodiment 34

The coil-forming laying head system of embodiment 33, wherein t1 is different compared to t2.

Embodiment 35

The coil-forming laying head system of embodiment 33, wherein t1 is substantially the same as t2.

Embodiment 36

The coil-forming laying head system of embodiment 33, wherein t1 is greater than t2.

Embodiment 37

The coil-forming laying head system of embodiment 33, wherein t1 is less than t2.

Embodiment 38

The coil-forming laying head system of embodiment 33, wherein t1 is at least about 0.1 mm, at least about 0.2 mm, at least about 0.5 mm, at least about 0.5 mm, at least about 1 mm.

Embodiment 39

The coil-forming laying head system of embodiment 33, wherein t1 is not greater than about 10 mm, not greater than about 8 mm, not greater than about 6 mm, not greater than about 4 mm.

Embodiment 40

The coil-forming laying head system of embodiment 33, wherein t2 is at least about 0.1 mm, at least about 0.2 mm, at least about 0.5 mm, at least about 0.5 mm, at least about 1 mm.

Embodiment 41

The coil-forming laying head system of embodiment 33, wherein t2 is not greater than about 10 mm, not greater than about 8 mm, not greater than about 6 mm, not greater than about 4 mm.

Embodiment 42

The coil-forming laying head system of embodiment 23, wherein the inner layer comprises a wear-resistant coating.

Embodiment 43

The coil-forming laying head system of embodiment 8, further comprising a third layer overlying the inner layer comprising a plurality of fibers forming a wound structure defining a third pitch (P3).

Embodiment 44

The coil-forming laying head system of embodiment 43, wherein the third layer is in direct contact with the second layer and the second layer is in direct contact with the inner layer.

Embodiment 45

The coil-forming laying head system of embodiment 43, wherein the first pitch (P1) is different than the third pitch (P3).

Embodiment 46

The coil-forming laying head system of embodiment 43, wherein the first pitch (P1) is less than the third pitch (P3).

Embodiment 47

The coil-forming laying head system of embodiment 43, wherein the second pitch (P2) is different than the third pitch (P3).

Embodiment 48

The coil-forming laying head system of embodiment 43, wherein the second pitch (P2) is less than the third pitch (P3).

Embodiment 49

The coil-forming laying head system of embodiment 43, wherein the first pitch (P1) extends in a first direction and the third pitch (P3) extends in a third direction.

Embodiment 50

The coil-forming laying head system of embodiment 49, wherein the first direction is the same as the third direction.

Embodiment 51

The coil-forming laying head system of embodiment 49, wherein the first direction is different than the third direction.

Embodiment 52

The coil-forming laying head system of embodiment 43, wherein the second pitch (P2) extends in a second direction and the third pitch (P3) extends in a third direction.

Embodiment 53

The coil-forming laying head system of embodiment 52, wherein the second direction is the same as the third direction.

Embodiment 54

The coil-forming laying head system of embodiment 52, wherein the second direction is different than the third direction.

Embodiment 55

The coil-forming laying head system of embodiment 43, wherein each of the fibers of the plurality of fibers of the inner layer comprises a first fiber diameter (FD1), each of the fibers of the plurality of fibers of the second layer comprises a second fiber diameter (FD2), and each of the fibers of the plurality of fibers of the third layer comprises a third fiber diameter (FD3).

Embodiment 56

The coil-forming laying head system of embodiment 55, wherein FD1 is different compared to FD2.

Embodiment 57

The coil-forming laying head system of embodiment 55, wherein FD1 is substantially the same as FD2.

Embodiment 58

The coil-forming laying head system of embodiment 55, wherein FD1 is less than FD2.

Embodiment 59

The coil-forming laying head system of embodiment 55, wherein FD1 is greater than FD2.

Embodiment 60

The coil-forming laying head system of embodiment 55, wherein FD1 is different compared to FD3.

Embodiment 61

The coil-forming laying head system of embodiment 55, wherein FD1 is substantially the same as FD3.

Embodiment 62

The coil-forming laying head system of embodiment 55, wherein FD1 is less than FD3.

Embodiment 63

The coil-forming laying head system of embodiment 55, wherein FD1 is greater than FD3.

Embodiment 64

The coil-forming laying head system of embodiment 55, wherein FD2 is different compared to FD3.

Embodiment 65

The coil-forming laying head system of embodiment 55, wherein FD2 is substantially the same as FD3.

Embodiment 66

The coil-forming laying head system of embodiment 55, wherein FD2 is less than FD3.

Embodiment 67

The coil-forming laying head system of embodiment 55, wherein FD2 is greater than FD3.

Embodiment 68

The coil-forming laying head system of embodiment 55, further comprising a fiber diameter factor (FD1/FD3) of not greater than about 0.98, not greater than about 0.96, not greater than about 0.94, not greater than about 0.92, not greater than about 0.9, not greater than about 0.88, not greater than about 0.86, not greater than about 0.84, not greater than about 0.82, not greater than about 0.80, and at least about 0.05, at least about 0.1, at least about 0.2, at least about 0.3, at least about 0.4, at least about 0.5, at least about 0.6.

Embodiment 69

The coil-forming laying head system of embodiment 55, further comprising a fiber diameter factor (FD2/FD3) of not greater than about 0.98, not greater than about 0.96, not greater than about 0.94, not greater than about 0.92, not greater than about 0.9, not greater than about 0.88, not greater than about 0.86, not greater than about 0.84, not greater than about 0.82, not greater than about 0.80, and at least about 0.05, at least about 0.1, at least about 0.2, at least about 0.3, at least about 0.4, at least about 0.5, at least about 0.6.

Embodiment 70

The coil-forming laying head system of embodiment 55, wherein each of the fibers of the plurality of fibers of the inner layer comprises a first composition, each of the fibers of the plurality of fibers of the second layer comprises a second composition, and each of the fibers of the plurality of fibers of the third layer comprises a third composition.

Embodiment 71

The coil-forming laying head system of embodiment 70, wherein the first composition is essentially the same as the third composition.

Embodiment 72

The coil-forming laying head system of embodiment 70, wherein the first composition is different than the third composition.

Embodiment 73

The coil-forming laying head system of embodiment 70, wherein the second composition is essentially the same as the third composition.

Embodiment 74

The coil-forming laying head system of embodiment 70, wherein the second composition is different than the third composition.

Embodiment 75

The coil-forming laying head system of embodiment 70, wherein the first composition comprises a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 76

The coil-forming laying head system of embodiment 70, wherein the first composition comprises a metal, wherein the first composition comprises a metal alloy, wherein the first composition comprises a material selected from the group consisting of ferrous materials, ferrous compounds, non-ferrous materials, non-ferrous compounds, nickel, aluminum, titanium, platinum, vanadium, iron, steel, and a combination thereof.

Embodiment 77

The coil-forming laying head system of embodiment 70, wherein the first composition comprises a composite including a combination of at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 78

The coil-forming laying head system of embodiment 70, wherein the second composition comprises a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 79

The coil-forming laying head system of embodiment 70, wherein the second composition comprises a metal, wherein the second composition comprises a metal alloy, wherein the second composition comprises a material selected from the group consisting of ferrous materials, ferrous compounds, non-ferrous materials, non-ferrous compounds, nickel, aluminum, titanium, platinum, vanadium, iron, steel, and a combination thereof.

Embodiment 80

The coil-forming laying head system of embodiment 70, wherein the second composition comprises a composite including a combination of at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 81

The coil-forming laying head system of embodiment 70, wherein the third composition comprises a material selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 82

The coil-forming laying head system of embodiment 70, wherein the third composition comprises a metal, wherein the third composition comprises a metal alloy, wherein the third composition comprises a material selected from the group consisting of ferrous materials, ferrous compounds, non-ferrous materials, non-ferrous compounds, nickel, aluminum, titanium, platinum, vanadium, iron, steel, and a combination thereof.

Embodiment 83

The coil-forming laying head system of embodiment 70, wherein the third composition comprises a composite including a combination of at least two materials selected from the group consisting of an inorganic material, an organic material, a metal, a metal alloy, a ceramic, a glass, a polymer, a carbide, an oxide, a boride, nitrides, an oxycarbides, an oxynitrides, a carbon-containing material, carbon fiber, carbon nanotubes, a natural material, and a synthetic material.

Embodiment 84

The coil-forming laying head system of embodiment 43 wherein the inner layer comprises a first thickness (t1), the second layer comprises a second thickness (t2), and the third layer comprises a third thickness (t3)

Embodiment 85

The coil-forming laying head system of embodiment 84, wherein t1 is different compared to t2.

Embodiment 86

The coil-forming laying head system of embodiment 84, wherein t1 is substantially the same as t2.

Embodiment 87

The coil-forming laying head system of embodiment 33, wherein t1 is greater than t2.

Embodiment 88

The coil-forming laying head system of embodiment 33, wherein t1 is less than t2.

Embodiment 89

The coil-forming laying head system of embodiment 33, wherein t1 is at least about 0.1 mm, at least about 0.2 mm, at least about 0.5 mm, at least about 0.5 mm, at least about 1 mm.

Embodiment 90

The coil-forming laying head system of embodiment 33, wherein t1 is not greater than about 10 mm, not greater than about 8 mm, not greater than about 6 mm, not greater than about 4 mm.

Embodiment 91

The coil-forming laying head system of embodiment 33, wherein t2 is at least about 0.1 mm, at least about 0.2 mm, at least about 0.5 mm, at least about 0.5 mm, at least about 1 mm.

Embodiment 92

The coil-forming laying head system of embodiment 33, wherein t2 is not greater than about 10 mm, not greater than about 8 mm, not greater than about 6 mm, not greater than about 4 mm.

Embodiment 93

The coil-forming laying head system of embodiment 84, wherein t1 is different compared to t3.

Embodiment 94

The coil-forming laying head system of embodiment 84, wherein t1 is substantially the same as t3.

Embodiment 95

The coil-forming laying head system of embodiment 84, wherein t1 is greater than t3.

Embodiment 96

The coil-forming laying head system of embodiment 84, wherein t1 is less than t3.

Embodiment 97

The coil-forming laying head system of embodiment 84, wherein t2 is different compared to t3.

Embodiment 98

The coil-forming laying head system of embodiment 84, wherein t2 is substantially the same as t3.

Embodiment 99

The coil-forming laying head system of embodiment 84, wherein t2 is greater than t3.

Embodiment 100

The coil-forming laying head system of embodiment 84, wherein t2 is less than t3.

Embodiment 101

The coil-forming laying head system of any one of embodiments 1, 2, 3, 4, and 5, wherein the laying pathway structure comprises a wall thickness of at least about 1 mm, at least about 2 mm, at least about 3 mm, at least about 4 mm, at least about 5 mm.

Embodiment 102

The coil-forming laying head system of any one of embodiments 1, 2, 3, 4, and 5, wherein the laying pathway structure comprises a wall thickness of not greater than about 20 mm, not greater than about 18 mm, not greater than about 16 mm, not greater than about 14 mm.

Embodiment 103

The coil-forming laying head system of any one of embodiments 1, 2, 3, 4, and 5, wherein the laying pathway structure comprises an inner width of at least about 1 mm, at least about 2 mm, at least about 3 mm, at least about 4 mm, at least about 5 mm, at least about 6 mm.

Embodiment 104

The coil-forming laying head system of any one of embodiments 1, 2, 3, 4, and 5, wherein the laying pathway structure comprises an inner width of not greater than about 100 mm, not greater than about 80 mm, not greater than about 70 mm, not greater than about 60 mm, not greater than about 50 mm.

Embodiment 105

The coil-forming laying head system of any one of embodiments 1, 2, 3, 4, and 5, wherein the laying pathway structure defines an elongated hollow pathway having a cross-sectional shape selected from the group of circular, elliptical, polygonal, irregular polygonal, and a combination thereof.

Embodiment 106

The coil-forming laying head system of any one of embodiments 1, 2, 3, 4, and 5, wherein the laying pathway structure is coupled to a mill line for forming metal.

Embodiment 107

The coil-forming laying head system of any one of embodiments 1, 2, 3, 4, and 5, wherein the laying pathway structure comprises a proximal portion extending along an axis, a terminal portion displaced radially and axially from the proximal portion, and an intermediate portion extending between the proximal portion and terminal portion in arcuate path.

Embodiment 108

The coil-forming laying head system of any one of embodiments 1, 2, 3, 4, and 5, wherein the laying pathway structure is coupled to a quill.

Embodiment 109

The coil-forming laying head system of embodiments 108, wherein the quill is configured to rotate about an axis and the pathway structure is configured to rotate about the axis with the quill.

Embodiment 110

The coil-forming laying head system of any one of embodiments 1, 2, 3, 4, and 5, wherein the elongated hollow pathway is configured to receive metal product and form the metal product into a helical formation of rings.

Embodiment 111

The coil-forming laying head system of any one of items 1, 2, 3, 4, and 5, wherein the laying pathway structure has a flexibility of at least about 55 mm at 23° C., at least about 60 mm, at least about 65 mm, at least about 70 mm, at least about 75 mm, at least about 80 mm, at least about 90 mm, at least about 100 mm, at least about 110 mm.

Embodiment 112

The coil-forming laying head system of embodiment 111, wherein the laying pathway structure has a flexibility of not greater than about 490 mm.

Embodiment 113

The coil-forming laying head system of any one of embodiments 1, 3, 4, and 5, wherein the laying pathway structure comprises a metal alloy of nickel and titanium having an elemental ratio (Ni/Ti) of nickel and titanium within a range including at least about 0.05 and not greater than about 0.95.

Embodiment 114

The coil-forming laying head system of any one of embodiments 2 and 113, wherein the elemental ratio (Ni/Ti) of nickel and titanium is at least about 0.08, at least about 0.1, at least about 0.15, at least about 0.2, at least about 0.25, at least about 0.3, at least about 0.35, at least about 0.4, at least about 0.45, at least about 0.48.

Embodiment 115

The coil-forming laying head system of any one of embodiments 2 and 113, wherein the elemental ratio (Ni/Ti) of nickel and titanium is not greater than about 0.9, not greater than about 0.85, not greater than about 0.8, not greater than about 0.75, not greater than about 0.7, not greater than about 0.65, not greater than about 0.6, not greater than about 0.55, not greater than about 0.53.

Embodiment 116

The coil-forming laying head system of any one of embodiments 1, 2, 4, and 5, wherein the laying pathway structure comprises a shape-memory metal.

Embodiment 117

The coil-forming laying head system of any one of embodiments 1, 2, 3, and 5, wherein the laying pathway structure comprises a superelastic material.

Embodiment 118

The coil-forming laying head system of any one of embodiments 1, 2, 3, 4, and 5, wherein the superelastic material comprises a plastic strain threshold of at least about 5% strain without plastic deformation, at least about 6% strain, at least about 7% strain, at least about 8% strain, at least about 9% strain, at least about 10% strain.

Embodiment 119

The coil-forming laying head system of any one of embodiments 1, 2, 3, 4, and 5, wherein the laying pathway structure comprises Nitinol™.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A coil-forming laying head system comprising:

a laying pathway structure defining an elongated hollow pathway adapted to transport elongated materials therethrough, wherein the laying pathway structure comprises a metal having a flexibility of at least about 50 mm at 23° C. based on a cantilever test in which a straight 1.5 inch diameter, schedule 160 tube having a length of 500 mm, an outer diameter of 48.3 mm, and a wall thickness of 7.14 mm, is attached to a fully rigid structure at a proximal end, and a weight of 1000 kgs is attached to the opposite terminal end of the tube and the pipe is allowed to flex for a time of 60 seconds.

2. The coil-forming laying head system of claim 1, wherein the laying pathway structure comprises a metal alloy of nickel and titanium having an elemental ratio (Ni/Ti) of nickel and titanium within a range including at least about 0.05 and not greater than about 0.95.

3. The coil-forming laying head system of claim 1, wherein the laying pathway structure comprises a shape-memory metal.

4. The coil-forming laying head system of claim 1, wherein the laying pathway structure comprises a superelastic material.

5. The coil-forming laying head system of claim 1, wherein the laying pathway structure comprises a plurality of fibers forming a wound structure defining a pitch (P), wherein the pitch (P) is at least equal to a diameter of the laying pathway structure.

6. The coil-forming laying head system of claim 5, wherein the laying pathway structure comprises:

an inner layer comprising a plurality of fibers forming a wound structure defining a first pitch (P1); and a second layer overlying the inner layer comprising a plurality of fibers forming a wound structure defining a second pitch (P2).

7. The coil-forming laying head system of claim 6, wherein each of the fibers of the plurality of fibers of the inner layer comprises a first fiber diameter (FD1), and each of the fibers of the plurality of fibers of the second layer comprises a second fiber diameter (FD2).

8. The coil-forming laying head system of claim 6, wherein each of the fibers of the plurality of fibers of the inner layer comprises a first composition and each of the fibers of the plurality of fibers of the second layer comprises a second composition.

9. The coil-forming laying head system of claim 6, wherein the inner layer comprises a first thickness (t1) and the second layer comprises a second thickness (t2).

10. The coil-forming laying head system of claim 6, further comprising a third layer overlying the inner layer comprising a plurality of fibers forming a wound structure defining a third pitch (P3).

11. The coil-forming laying head system of claim 10, wherein each of the fibers of the plurality of fibers of the inner layer comprises a first fiber diameter (FD1), each of the fibers of the plurality of fibers of the second layer comprises a second fiber diameter (FD2), and each of the fibers of the plurality of fibers of the third layer comprises a third fiber diameter (FD3).

12. The coil-forming laying head system of claim 10, wherein each of the fibers of the plurality of fibers of the inner layer comprises a first composition, each of the fibers of the plurality of fibers of the second layer comprises a second composition, and each of the fibers of the plurality of fibers of the third layer comprises a third composition.

13. The coil-forming laying head system of claim 10, wherein the inner layer comprises a first thickness (t1), the second layer comprises a second thickness (t2), and the third layer comprises a third thickness (t3).

14. The coil-forming laying head system of claim 1, wherein the laying pathway structure comprises an inner width of at least about 1 mm and not greater than about 100 mm.

15. The coil-forming laying head system of claim 1, wherein the laying pathway structure is coupled to a mill line for forming metal.

16. The coil-forming laying head system of claim 1, wherein the laying pathway structure is coupled to a quill.

17. The coil-forming laying head system of claim 1, wherein the elongated hollow pathway is configured to receive metal product and form the metal product into a helical formation of rings.

18. The coil-forming laying head system of claim 1, wherein the flexibility of the laying pathway structure is at least about 55 mm and not greater than about 490 mm.

19. The coil-forming laying head system of claim 1, wherein the laying pathway structure comprises at least one fiber forming a wound structure.

20. The coil-forming laying head system of claim 19, wherein the at least one fiber comprises an alloy of iron.

* * * * *